US009966030B2

(12) United States Patent
Lee et al.

(10) Patent No.: US 9,966,030 B2
(45) Date of Patent: May 8, 2018

(54) LIQUID CRYSTAL DISPLAY DEVICE AND DRIVING METHOD THEREOF

(71) Applicant: Samsung Display Co., Ltd., Yongin-Si, Gyeonngi-Do (KR)

(72) Inventors: Jongjae Lee, Hwaseong-si (KR); Sujin Kim, Ulsan (KR); Junki Hong, Bucheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days. days.

(21) Appl. No.: 15/341,994

(22) Filed: Nov. 2, 2016

(65) Prior Publication Data

US 2017/0213517 A1 Jul. 27, 2017

(30) Foreign Application Priority Data

Jan. 22, 2016 (KR) ..... 10-2016-0008193

(51) Int. Cl.
*G09G 3/36* (2006.01)

(52) U.S. Cl.
CPC ..... *G09G 3/3688* (2013.01); *G09G 3/3696* (2013.01); *G09G 2310/027* (2013.01); *G09G 2310/08* (2013.01); *G09G 2320/0673* (2013.01)

(58) Field of Classification Search
CPC ..... G09G 2320/0276; G09G 2320/0673
See application file for complete search history.

(56) References Cited

U.S. PATENT DOCUMENTS

2010/0026722 A1* 2/2010 Kondo ..... G09G 3/2007 345/660
2011/0037760 A1* 2/2011 Kim ..... G09G 3/3614 345/214
2015/0161961 A1 6/2015 Qu et al.
2015/0206682 A1 7/2015 Sala et al.
2015/0356932 A1* 12/2015 Kim ..... G09G 3/3688 345/690
2016/0125781 A1* 5/2016 Yang ..... G09G 3/2003 345/694

FOREIGN PATENT DOCUMENTS

JP 2013-186384 A 9/2013
KR 10-2007-0025648 A 3/2007
KR 10-2014-0060007 A 5/2014

* cited by examiner

*Primary Examiner* — Sanghyuk Park
(74) *Attorney, Agent, or Firm* — Lewis Roca Rothgerber Christie LLP

(57) ABSTRACT

A liquid crystal display device according to the present disclosure includes a timing controller, a power supply unit, a data supply unit, and a liquid crystal display panel. The timing controller analyzes image data to sense a target pattern, and generates an operating signal in a case where the target pattern is sensed. The power supply unit generates first to fourth gamma voltages in a case where the operating signal is not received. The power supply unit generates first to fourth modulation voltages after a variable time in a case where the operating signal is received. The difference between the first and second modulation voltages is smaller than the difference between the first and second gamma voltages, and the difference between the third and fourth modulation voltages is smaller than the difference between the third and fourth gamma voltages.

20 Claims, 10 Drawing Sheets

LIQUID CRYSTAL DISPLAY DEVICE AND DRIVING METHOD THEREOF

CROSS-REFERENCE TO RELATED APPLICATION

This application claims priority to and the benefit of Korean Patent Application No. 10-2016-0008193, filed in the Korean Intellectual Property Office on Jan. 22, 2016, the entire content of which is hereby incorporated herein by reference.

BACKGROUND

1. Field

The present disclosure herein relates to a liquid crystal display device (LCD) and a driving method thereof, and more particularly, to a display device that decreases power consumption and a driving method thereof.

2. Description of the Related Art

Flat-panel type display devices include a liquid crystal display device (LCD), a plasma display panel (PDP), a field emission display device (FED), and a light emitting diode display device. Among others, the LCD is excellent in resolution and picture quality and thus being widely used for a notebook computer, a terminal, a TV or the like.

The LCD uses an electric field to adjust the light transmittance of a liquid crystal to display an image.

Driving methods of the LCD include line inversion, column inversion and dot inversion methods according to the phase of a data voltage that is applied to a data line. The line inversion method is a method of inverting and applying the phase of image data applied to a data line for each pixel row, the column inversion method is a method of inverting and applying the phase of image data applied to a data line for each pixel column, and the dot inversion method is a method of inverting and applying the phase of image data applied to a data line for each pixel row and each pixel column.

SUMMARY

Aspects of embodiments of the present disclosure are directed to a liquid crystal display device that decreases power consumption and a driving method thereof.

An embodiment of the present disclosure provides a liquid crystal display device including a timing controller, a power supply unit, a data driver, and a liquid crystal display panel.

The timing controller analyzes image data to sense a target pattern, generates an operating signal in a case where the target pattern is sensed, and generates converted data based on the image data.

The power supply unit generates first to fourth gamma voltages in a case where the operating signal is not received. The power supply unit generates first to fourth modulation voltages in a case where the operating signal is received. In the case where the operating signal is not received, a difference between the first and second gamma voltages is a positive data voltage corresponding to a maximum gray level, and a difference between the third and fourth gamma voltages is a negative data voltage corresponding to a maximum gray level. In the case where the operating signal is received, a difference between the first and second modulation voltages is a positive data voltage corresponding to a maximum gray level, and a difference between the third and fourth modulation voltages is a negative data voltage corresponding to a maximum gray level. The difference between the first and second modulation voltages may be smaller than the difference between the first and second gamma voltages and the difference between the third and fourth modulation voltages may be smaller than the difference between the third and fourth gamma voltages.

The data driver receives the converted data and converts the converted data into a data voltage based on the first to fourth gamma voltages or the first to fourth modulation voltages.

In one embodiment, the power supply unit may include a first driving voltage supply unit, a second driving voltage supply unit, a driving voltage control unit, and a resistor unit.

The first driving voltage supply unit may generate a first driving voltage for generating the first to fourth gamma voltages. The second driving voltage supply unit may generate a second driving voltage lower than the first driving voltage for generating the first to fourth modulation voltages.

The driving voltage control unit may output the first driving voltage in a case where the operating signal is not received, and output the second driving voltage after a variable time in a case where the operating signal is received.

The resistor unit may be connected to the driving voltage control unit. The resistor unit may receive the first driving voltage to output the first to fourth gamma voltages to the data driver or receive the second driving voltage to output the first to fourth modulation voltages to the data driver. The resistor unit may include first to fifth resistors that are connected in series between the driving voltage control unit and a grounded terminal. The first resistor and the fifth resistor may have a same resistance, and the second resistor and the fourth resistor may have a same resistance.

In one embodiment, the power supply unit may further include a time adjuster configured to control the variable time.

In one embodiment, the power supply unit may include a gamma data supply unit, a modulation data supply unit, a gamma data control unit, and a DA converter unit.

The gamma data supply unit may generate gamma data for generating the first to fourth gamma voltages. The modulation data supply unit may generate modulation data for generating the first to fourth modulation voltages.

The gamma data control unit may output the gamma data in a case where the operating signal is not received, and output the modulation data after the variable time in a case where the operating signal is received.

The DA converter unit may be connected to the gamma data control unit. The DA converter unit may receive the gamma data to output the first to fourth gamma voltages to the data driver or receive the modulation data to output the first to fourth modulation voltages to the data driver. The DA converter unit may include first to fourth DA converters that are connected in parallel between the gamma data control unit and the data driving unit.

In one embodiment, the power supply unit may include a first driving voltage supply unit, a second driving voltage supply unit, and a driving voltage control unit.

The first driving voltage supply unit may generate a first driving voltage for generating the first to fourth gamma voltages. The second driving voltage supply unit may generate a second driving voltage lower than the first driving voltage for generating the first to fourth modulation voltages.

The driving voltage control unit may output the first driving voltage to the DA converter unit in a case where the operating signal is not received. The driving voltage control unit may output the second driving voltage to the DA converter unit after the variable time in a case where the operating signal is received.

In one embodiment, a difference between the first and second gamma voltages and a difference between the third and fourth gamma voltages may be same, and a difference between the first and second modulation voltages and a difference between the third and fourth modulation voltages may be same.

In one embodiment, the power supply unit may further include a time adjuster configured to control the variable time.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain principles of the present disclosure. In the drawings.

DETAILED DESCRIPTION

Since the present disclosure may encompass embodiments having various different forms, specific embodiments are shown in the accompanying drawings and provided in detail in the detailed description. However, it should be understood that the embodiments are not intended to limit the present disclosure to the disclosed forms and include all changes, equivalents and replacements that are included in the spirit and technical scope of the present disclosure.

Figure 1:
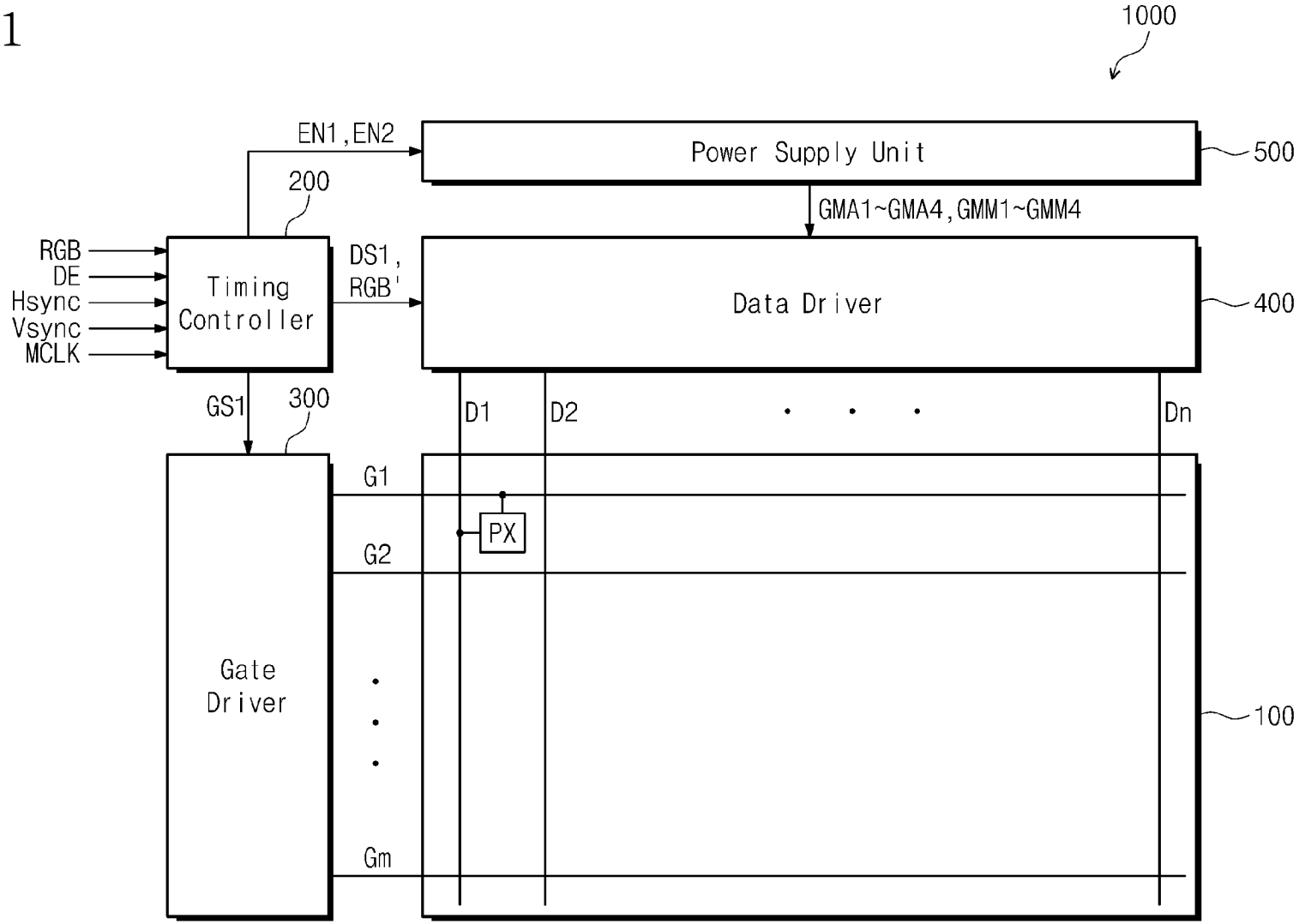
FIG. 1 is a block diagram of a liquid crystal display device (LCD) according to an embodiment of the present disclosure.

FIG. 1 is a block diagram of a liquid crystal display device (LCD) 1000 according to an embodiment of the present disclosure.

As shown in FIG. 1, the LCD 1000 includes a liquid crystal display panel 100, a timing controller 200, a gate driver 300, a data driver 400, and a power supply unit 500.

The liquid crystal display panel 100 includes a plurality of gate lines G1 to Gm that receive gate signals and a plurality of data lines to Dn that receive data voltages. The gate lines G1 to Gm and the data lines to Dn are insulated from each other and cross each other. The gate lines G1 to Gm and the data lines D1 to Dn define pixel regions, each of which includes a pixel PX that displays an image. FIG. 1 illustrates a pixel PX that is connected to a first gate line G1 and to a first data line D1. The timing controller 200 receives image data RGB and a control signal from an external graphic control unit. The control signal may include a vertical synchronous signal (hereinafter, referred to as a 'Vsync signal') that is a frame identification signal, a data enable signal (hereinafter, referred to as a 'DE signal') that has a high level only while data is output, in order to show a region which data enters, and a main clock signal MCLK. The timing controller 200 performs data conversion on the image data RGB to enable the data to be suitable for the specification of the data driver 400 to output converted data RGB' to the data driver 400. The timing controller 200 generates a gate control signal GS1 and a data control signal DS1. The timing controller 200 outputs the gate control signal GS1 to the gate driver 300 and outputs the data control signal DS1 to the data driver 400. The gate control signal GS1 is a signal for driving the gate driver 300 and the data control signal DS1 is a signal for driving the data driver 400.

The timing controller 200 analyzes the image data RGB frame based on frame data. The timing controller 200 may apply an inversion driving method to the frame data. The timing controller 200 senses a target pattern PA in the analyzed image data RGB. In the case where the target pattern PA is not sensed, the timing controller 200 outputs a normal signal EN1 to the power supply unit 500. In the case where the target pattern PA is sensed, the timing controller 200 outputs an operating signal EN2 to the power supply unit 500. Detailed descriptions are provided below.

The power supply unit 500 generates first to fourth gamma voltages GMA1 to GMA4 in the case where the normal signal EN1 is received, and generates first to fourth modulation voltages GMM1 to GMM4 in the case where the operating signal EN2 is received. The power supply unit 500 outputs the first to fourth gamma voltages GMA1 to GMA4 or the first to fourth modulation voltages GMM1 to GMM4 to the data driver 400. The detailed driving processes are described below.

The gate driver 300 generates a gate signal based on the gate control signal GS1 and outputs the gate signal to the gate lines G1 to Gm.

The data driver 400 receives the converted image data RGB' and the data control signal DS1 from the timing controller 200 and receives the first to fourth gamma voltages GMA1 to GMA4 or the first to fourth modulation voltages GMM1 to GMM4 from the power supply unit 500. The data driver 400 converts the converted data RGB' into a data voltage based on the first to fourth gamma voltages GMA1 to GMA4 or the first to fourth modulation voltages GMM1 to GMM4 to output the data voltage to the data lines D1 to Dn.

Figure 2:
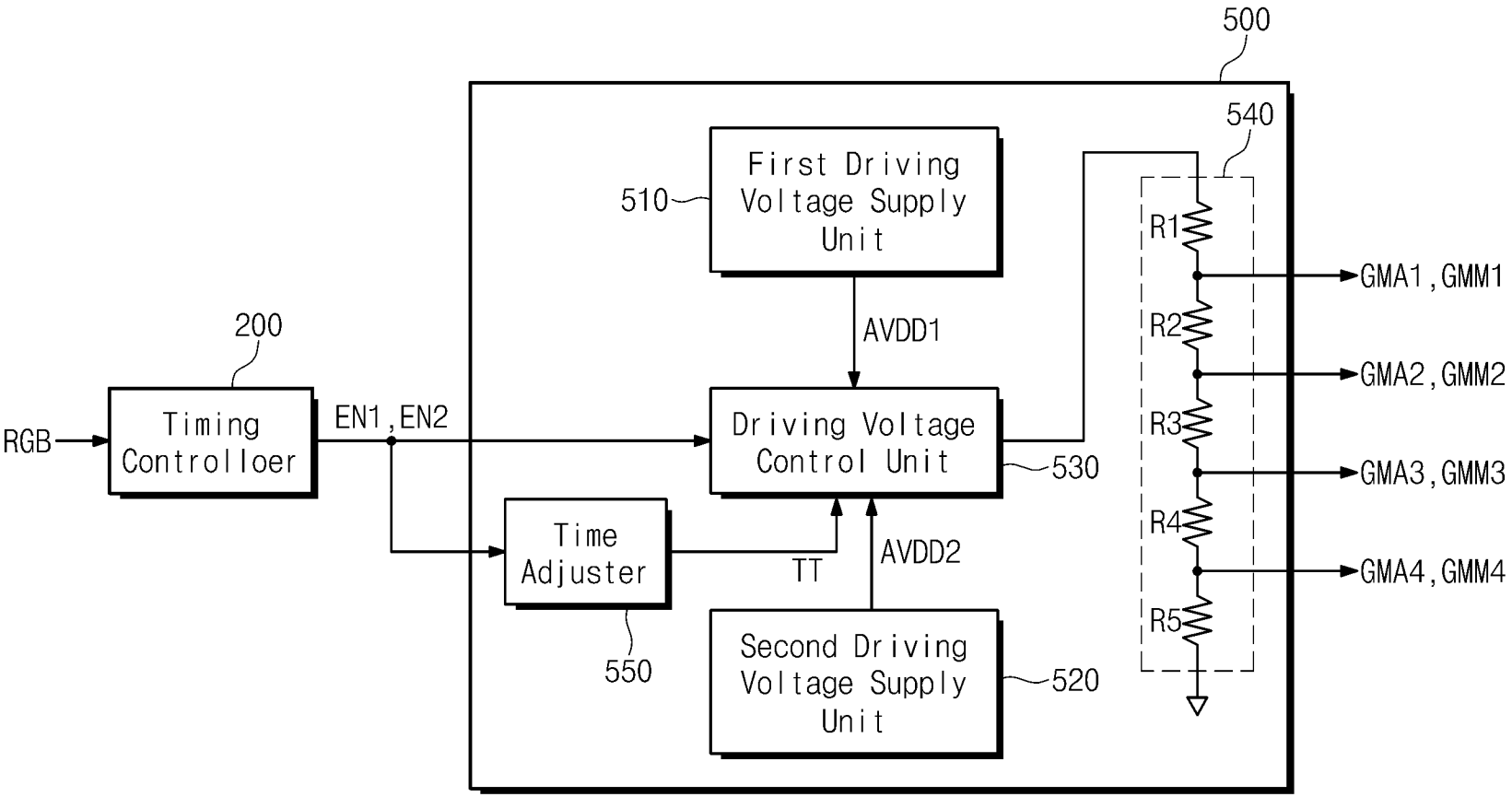
FIG. 2 is a block diagram of a timing controller and a power supply unit according to an embodiment of the present disclosure.

FIG. 2 is a block diagram of the timing controller 200 and the power supply unit 500 according to an embodiment of the present disclosure.

The timing controller 200 receives the image data RGB. The timing controller 200 analyzes the image data RGB to sense the target pattern PA. In the case where the target pattern PA is not sensed, the timing controller 200 outputs the normal signal EN1. In the case where the target pattern PA is sensed, the timing controller 200 outputs the operating signal EN2.

The power supply unit 500 includes a first driving voltage supply unit 510, a second driving voltage supply unit 520, a driving voltage control unit 530, a voltage divider unit such as a resistor unit 540, and a time adjuster 550.

The first driving voltage supply unit 510 generates a first driving voltage AVDD1 for generating the first to fourth gamma voltages GMA1 to GMA4. The second driving voltage supply unit 520 generates a second driving voltage AVDD2 for generating the first to fourth modulation voltages GMM1 to GMM4. The first driving voltage AVDD1 has a higher potential than the second driving voltage AVDD2.

The driving voltage control unit 530 receives the first driving voltage AVDD1 and the second driving voltage AVDD2 from the first driving voltage supply unit 510 and the second driving voltage supply unit 520, respectively. In the case where the target pattern PA is not sensed, the driving voltage control unit 530 receives the normal signal EN1 and outputs the first driving voltage AVDD1 to the resistor unit 540. In the case where the target pattern PA is sensed, the driving voltage control unit 530 outputs the second driving voltage AVDD2 having a potential lower than the first driving voltage AVDD1 to the resistor unit 540 in order to decrease power consumption. The driving voltage control unit 530 may be a switch that selectively connects the first driving voltage supply unit 510 or the second driving voltage supply unit 520 to the resistor unit 540 according to the reception of the operating signal EN2.

The resistor unit 540 receives the first driving voltage AVDD1 or the second driving voltage AVDD2 selectively from the driving voltage control unit 530. The resistor unit 540 outputs the first to fourth gamma voltages GMA1 to GMA4 to the data driver 400 in the case where the first driving voltage AVDD1 is received. The resistor unit 540 outputs the first to fourth modulation voltages GMM1 to GMM4 to the data driver 400, in the case where the second driving voltage AVDD2 is received.

The resistor unit 540 includes a first resistor R1, a second resistor R2, a third resistor R3, a fourth resistor R4, and a fifth resistor R5. The first to fifth resistors R1 to R5 are connected in series between the driving voltage control unit 530 and the ground terminal. The first to fifth resistors R1 to R5 divide the first driving voltage AVDD1 to generate the first to fourth gamma voltages GMA1 to GMA4. The first to fifth resistors R1 to R5 divide the second driving voltage AVDD2 to generate the first to fourth modulation voltages GMM1 to GMM4.

In particular, in the case where the driving voltage control unit 530 receives the normal signal EN1, one terminal of the first resistor R1 may be connected to the driving voltage control unit 530 to receive the first driving voltage AVDD1. The other terminal of the first resistor R1 provides the first gamma voltage GMA1 to the data driver 400. One terminal of the second resistor R2 is connected to the other terminal of the first resistor R1 and the other terminal of the second resistor R2 provides the second gamma voltage GMA2 to the data driver 400. One terminal of the third resistor R3 is connected to the other terminal of the second resistor R2 and the other terminal of the third resistor R3 provides the third gamma voltage GMA3 to the data driver 400. One terminal of the fourth resistor R4 is connected to the other terminal of the third resistor R3 and the other terminal of the fourth resistor R4 provides the fourth gamma voltage GMA4 to the data driver 400. One terminal of the fifth resistor R5 is connected to the other terminal of the fourth resistor R4 and the other terminal of the fifth resistor R5 is grounded.

In the case where the driving voltage control unit 530 receives the operating signal EN2, one terminal of the first resistor R1 may be connected to the driving voltage control unit 530 to receive the second driving voltage AVDD2. The other terminal of the first resistor R1 provides the first modulation voltage GMM1 to the data driver 400. One terminal of the second resistor R2 is connected to the other terminal of the first resistor R1 and the other terminal of the second resistor R2 provides the second modulation voltage GMM2 to the data driver 400. One terminal of the third resistor R3 is connected to the other terminal of the second resistor R2, and the other terminal of the third resistor R3 provides the third modulation voltage GMM3 to the data driver 400. One terminal of the fourth resistor R4 is connected to the other terminal of the third resistor R3, and the other terminal of the fourth resistor R4 provides the fourth modulation voltage GMM4 to the data driver 400. One terminal of the fifth resistor R5 is connected to the other terminal of the fourth resistor R4, and the other terminal of the fifth resistor R5 is grounded. The first to fourth gamma voltages GMA1 to GMA4 and the first to fourth modulation voltages GMM1 to GMM4 are determined by the resistance ratio of the first to fifth resistors R1 to R5 that are connected in series. The first resistor R1 and the fifth resistor R5 may have the same resistance and the second resistor R2 and the fourth resistor R4 may have the same resistance.

The time adjuster 550 controls a variable time TT over which the first driving voltage AVDD1 is changed to the second driving voltage AVDD2. The variable time TT is a time between when the driving voltage control unit 530 receives the operating signal EN2 and when the driving voltage control unit 530 outputs the second driving voltage AVDD2. In some embodiments, the variable time TT is a set time.

In the case where the first driving voltage AVDD1 changes immediately to the second driving voltage AVDD2 when the operating signal EN2 is received, the first to fourth gamma voltages GMA1 to GMA4 immediately change to the first to fourth modulation voltages GMM1 to GMM4. In this case, a variation in brightness of an image may be recognized. The time adjuster 550 outputs the variable time TT to the driving voltage control unit 530 to gradually change the first to fourth gamma voltages GMA1 to GMA4 to the first to fourth modulation voltages GMM1 to GMM4 over the duration of the variable time TT. This prevents a variation in brightness from becoming recognized. If the variable time TT is too short, the variation in brightness may be recognized and if the variable time TT is too long, heat emission and power consumption due to the target pattern PA may not be mitigated.

The time adjuster 550 may receive the operating signal EN2 to adjust the duration of the variable time TT based on the operating signal EN2. Alternatively, the time adjuster 550 may output, to the driving voltage control unit 530, a set variable time TT without receiving the operating signal EN2.

Figure 3:
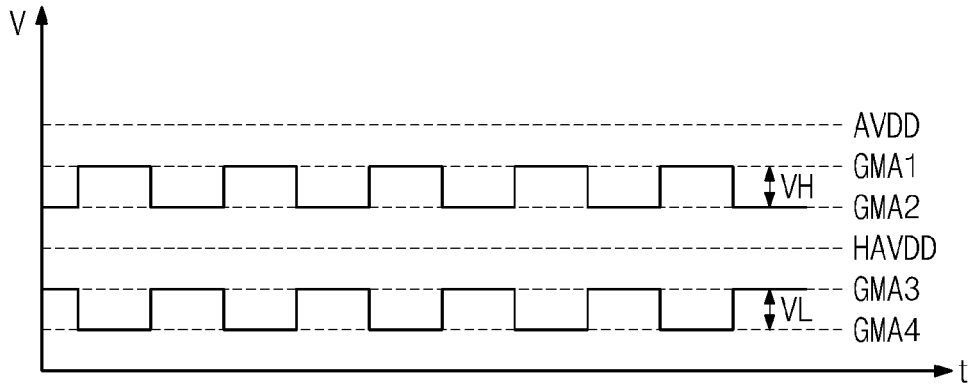
FIG. 3 is a graph of a data voltage according to a target pattern.
Figure 4:
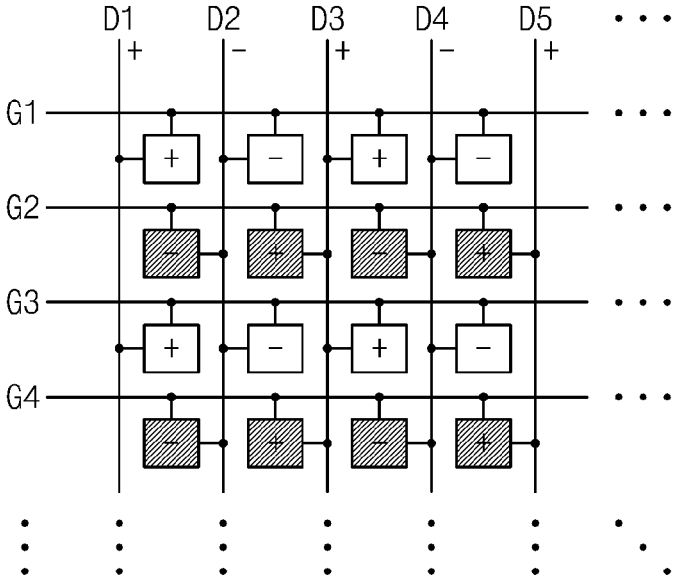
FIG. 4 shows an image displayed on a liquid crystal display panel in the case where a target pattern is input to a timing controller.

FIG. 3 is a graph of a data voltage according to the target pattern PA, and FIG. 4 shows an image displayed on the liquid crystal display panel 100 in the case where the target pattern PA is input to the timing controller 200. A data voltage can refer to the data voltage including a positive data voltage and a negative data voltage.

The target pattern PA may appear in the image data RGB and cause the LCD 1000 to display the target pattern PA. In the case where the LCD 1000 displays the target pattern PA, more power than usual may be consumed.

Referring to FIG. 3, the difference VH between the first and second gamma voltages GMA1 and GMA2 corresponds to the maximum gray level (e.g., the maximum gray level of a grayscale) of a positive data voltage. The difference VL between the third and fourth gamma voltages GMA3 and GMA4 corresponds to the maximum gray level of a negative data voltage. The first gamma voltage GMA1 and the second gamma voltage GMA2 are voltages higher than a half driving voltage HAVDD that is a half of the driving voltage AVDD, and the third gamma voltage GMA3 and the fourth gamma voltage GMA4 are voltages lower than the half driving voltage HAVDD.

The difference VH between the first and second gamma voltages GMA1 and GMA2 and the difference VL between the third and fourth gamma voltages GMA3 and GMA4 may be the same. The first gamma voltage GMA1 and the fourth gamma voltage GMA4 are symmetric with respect to the half driving voltage HAVDD. The second gamma voltage GMA2 and the third gamma voltage GMA3 are symmetric with respect to the half driving voltage HAVDD.

A data voltage according to the target pattern PA may have a waveform in which the first gamma voltage GMA1 and the second gamma voltage GMA2 corresponding to the maximum gray level of the positive data voltage are alternately output and the third gamma voltage GMA3 and the fourth gamma voltage GMA4 corresponding to the maximum gray level of the negative data voltage are alternately output.

Power may be consumed at a point where the data voltage rises from the second gamma voltage GMA2 to the first gamma voltage GMA1. Power consumption increases with an increase in voltage rise magnitude. Thus, it is possible to decrease power consumption by decreasing the size of the difference VH of the first and second gamma voltages (or the difference VL between the third and fourth gamma voltages). The first to fourth gamma voltages GMA1 to GMA4 are generated by the dividing of the driving voltage AVDD. Thus, it is possible to decrease the driving voltage AVDD to decrease power consumption.

In the case where the waveform of FIG. 3 is applied to the data lines D1 to Dn in FIG. 4, the first gamma voltage GMA1 and the second gamma voltage GMA2 may determine the maximum gray level of the positive data voltage that is output to odd-numbered data lines D1, D3, and D5 and the third gamma voltage GMA3, and the fourth gamma voltage GMA4 may determine the maximum gray level of the negative data voltage that is output to even-numbered data lines D2 and D4.

In particular, the odd-numbered data lines D1, D3, and D5 may alternately receive the first gamma voltage GMA1 and the second gamma voltage GMA2 by the target pattern PA. The even-numbered data lines D2 and D4 may alternately receive the third gamma voltage GMA3 and the fourth gamma voltage GMA4.

FIG. 4 shows an example where pixels PX arranged in an odd row are connected to a left data line and pixels PX arranged in an even row are connected to a right data line. In the case where a data voltage applied to each of the pixels is positive, it is represented by + and in the case where the data voltage is negative, it is represented by −. Also, a pixel to which a data voltage having the minimum gray level is applied is represented by hatching and a pixel to which a data voltage having the maximum gray level is applied is not represented by hatching.

The data voltage of FIG. 3 is applied to the pixels PX in FIG. 4. A second data line D2 is described as an example. The second data line D2 receives a negative data voltage according to the target pattern PA. The data voltage applied to D2 alternates between the third gamma voltage GMA3 and the fourth gamma voltage GMA4 on a line-by-line basis. A pixel to which the second data line D2 and a first gate line G1 are connected may receive the fourth gamma voltage GMA4. During the next frame, the pixel to which the second data line D2 and a second gate line G2 are connected receives the third gamma voltage GMA3 that is the next value of the negative data voltage. A pixel to which the second data line D2 and a third gate line G3 are connected receives the fourth gamma voltage GMA4 that is the next value of the negative data voltage. A pixel to which the second data line D2 and a fourth gate line G4 are connected receives the third gamma voltage GMA3 that is the next value of the negative data voltage.

Since the data voltages applied to the data lines D1 to Dn are the first gamma voltage GMA1 and the second gamma voltage GMA2 (or the third gamma voltage GMA3 and the fourth gamma voltage GMA4), LCD 1000 consumes great power in comparison to the image data RGB.

Figure 5:
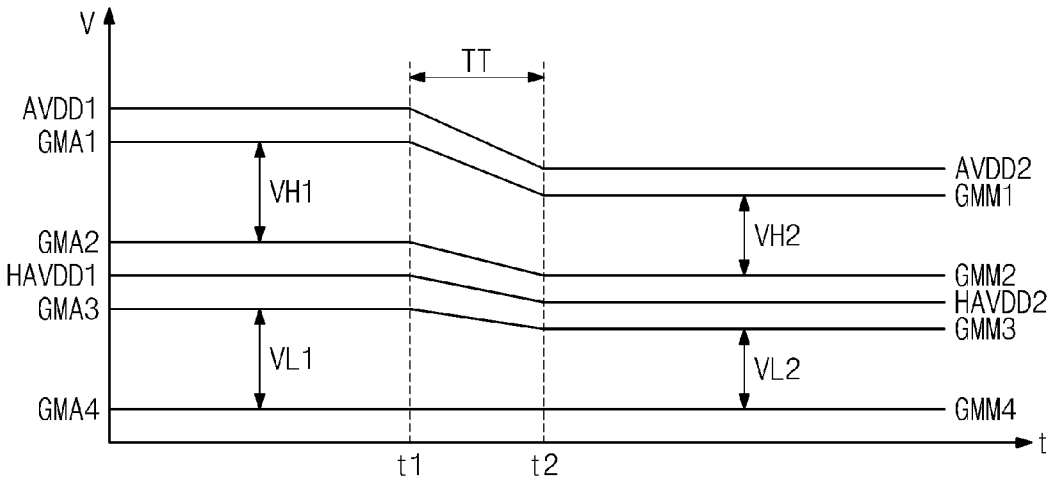
FIG. 5 is a graph of an output voltage of the power supply unit in FIG. 2.

FIG. 5 is a graph of an output voltage of the power supply unit 500 in FIG. 2.

Since the target pattern PA is not sensed until a first time t1, the first driving voltage AVDD1 is applied to the resistor unit 540. The resistor unit 540 divides the first driving voltage AVDD1 to output the first to fourth gamma voltages GMA1 to GMA4. The difference VH1 between the first and second gamma voltages and the difference VL1 between the third and fourth gamma voltages have the same value and are symmetric with respect to the half driving voltage HAVDD1.

The target pattern PA is sensed at the first time t1 and the driving voltage control unit 530 receives the operating signal EN2. At the first time t1, the driving voltage control unit 530 receiving the operating signal EN2 may not immediately output the second driving voltage AVDD2. The reason is that a variation in brightness of an image may be recognized.

From the first time t1 to a second time t2, the driving voltage control unit 530 gradually lowers the voltage applied to the resistor unit 540 from the first driving voltage AVDD1 to the second driving voltage AVDD2. The first to fourth gamma voltages GMA1 to GMA4 gradually drops to the first to fourth modulation voltages GMM1 to GMM4, respectively. A time taken to lower the first driving voltage AVDD1 to the second driving voltage AVDD2 is determined by the variable time TT that is set by the time adjuster 550. The variable time TT is a time between the second time t2 and the first time t1.

From the second time t2, the second driving voltage AVDD2 is applied to the resistor unit 540. The resistor unit 540 divides the second driving voltage AVDD2 to output the first to fourth modulation voltages GMM1 to GMM4. The first to fourth modulation voltages GMM1 to GMM4 have lower potentials than the first to fourth gamma voltages GMA1 to GMA4, respectively. The difference VH2 between the first and second modulation voltages is smaller than the difference VH1 between the first and second gamma voltages and the difference VL2 between the third and fourth modulation voltages is smaller than the difference VL1 between the third and fourth gamma voltages. The difference VH2 between the first and second modulation voltages and the difference VL2 between the third and fourth modulation voltages have the same value and are symmetric with respect to a second half driving voltage HAVDD2.

In one embodiment, the first driving voltage AVDD1 is about 17 V and the difference VH1 between the first and second gamma voltages and the difference VL1 between the third and fourth gamma voltages are each about 7.11 V. In the case where the second driving voltage AVDD2 is about 14 V, the difference VH2 between the first and second modulation voltages and the difference VL2 between the third and fourth modulation voltages are each about 5.85 V. Power consumption may be decreased by about 32% from about 26.9 W to about 18.3 W.

Figure 6:
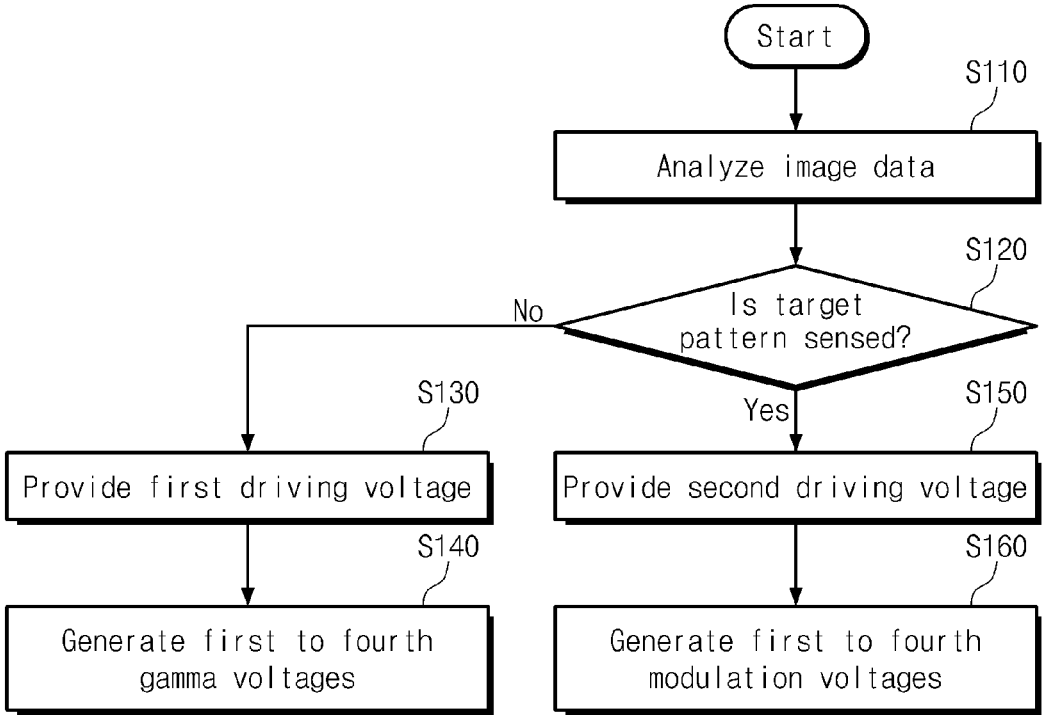
FIG. 6 is a flow chart of a driving method of an LCD according to an embodiment of the present disclosure.

FIG. 6 is a flow chart of a driving method of the LCD 1000 according to an embodiment of the present disclosure. The driving method of the LCD 1000 in FIG. 6 may be performed by the power supply unit 500 and timing controller 200 in FIG. 2.

Referring to FIG. 6, the driving method of the LCD 1000 includes analyzing the image data RGB in act S110 and sensing the target pattern in act S120. In the case where the target pattern PA is not sensed, the method further includes providing the first driving voltage AVDD1 in act S130 and generating the first to fourth gamma voltages GMA1 to GMA4 in act S140. In the case where the target pattern PA is sensed, the method further includes providing the second driving voltage AVDD2 in act S150 and generating the first to fourth modulation voltages GMM1 to GMM4 in act S160.

After generating the first to fourth gamma voltages GMA1 to GMA4 in act S140, the analyzing of the image data RGB in act S110 and the sensing of the target pattern PA in act S120 may be repeated. In the case where the target pattern PA is sensed, the providing of the second driving voltage AVDD2 lower than the first driving voltage AVDD1 in act S150 and the generating of the first to fourth modulation voltages GMM1 to GMM4 in act S160 are performed. In this case, the providing of the second driving voltage AVDD2 in act S150 may be performed after the variable time TT from when the target pattern PA is sensed. After generating the first to fourth modulation voltages GMM1 to GMM4 in act S160, the analyzing of the image data RGB in act S110 and the sensing of the target pattern PA in act S120 may be repeated.

Figure 7:
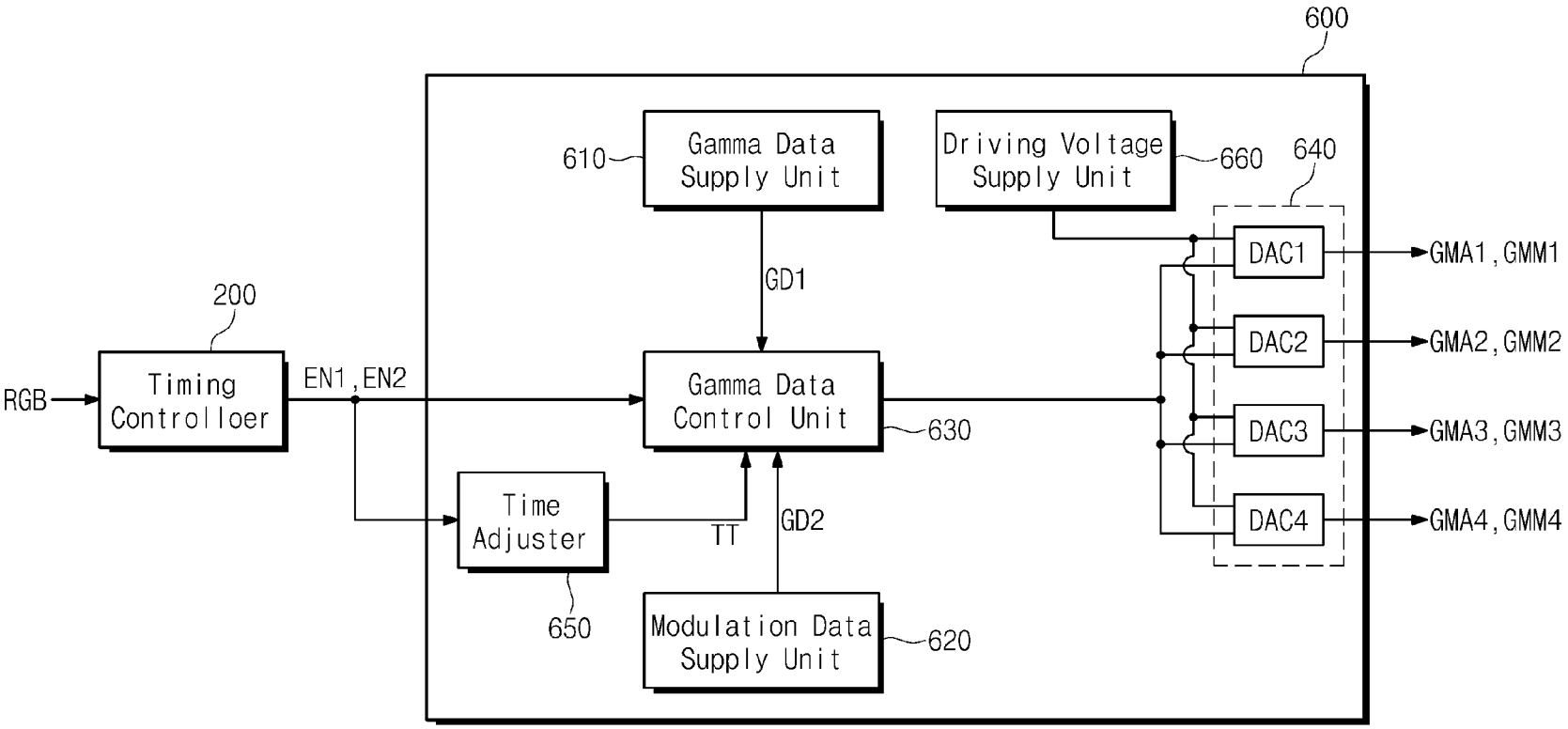
FIG. 7 is a block diagram of a timing controller and a power supply unit according to another embodiment of the present disclosure.

FIG. 7 is a block diagram of the timing controller 200 and a power supply unit 600 according to another embodiment of the present disclosure.

The power supply unit 600 includes a gamma data supply unit 610, a modulation data supply unit 620, a gamma data control unit 630, a digital to analog converter unit (hereinafter 'DA converter unit') 640, a time adjuster 650, and a driving voltage supply unit 660.

The gamma data supply unit 610 generates gamma data GD1 for generating the first to fourth gamma voltages GMA1 to GMA4. The modulation data supply unit 620 generates modulation data GD2 for generating the first to fourth modulation voltages GMM1 to GMM4.

The gamma data GD1 and the modulation data GD2 may be digital signals. The gamma data GD1 may include four pieces of data for generating the first to fourth gamma voltage GMA1 to GMA4. The modulation data GD2 may include four pieces of data for generating the first to fourth modulation voltage GMM1 to GMM4.

The gamma data control unit 630 receives the operating signal EN2 that the timing controller 200 outputs upon sensing the target pattern PA, and receives the gamma data GD1 and the modulation data GD2 from the gamma data supply unit 610 and the modulation data supply unit 620, respectively. In the case where the target pattern PA is not sensed, the gamma data control unit 630 receives the normal signal EN1 and outputs the gamma data GD1 to the DA converter unit 640. In the case where the target pattern PA is sensed, the gamma data control unit 630 receives the operating signal EN2 and outputs the modulation data GD2 to the DA converter unit 640 in order to decrease power consumption. The gamma data control unit 630 may be a switch that selectively connects the gamma data supply unit 610 or the modulation data supply unit 620 to the DA converter unit 640 according to the reception of the operating signal EN2.

The DA converter unit 640 receives the gamma data GD1 or the modulation data GD2 from the gamma data control unit 630. The DA converter unit 640 outputs the first to fourth gamma voltages GMA1 to GMA4 to the data driver 400 in the case where the gamma data GD1 is received. The DA converter unit 640 outputs the first to fourth modulation voltages GMM1 to GMM4 to the data driver 400 in the case where the modulation data GD2 is received.

The DA converter unit 640 includes a first digital to analog converter (hereinafter 'DA converter') DA1, a second DA converter DA2, a third DA converter DA3, and a fourth DA converter DA4. The first to fourth DA converters DA1 to DA4 are connected in parallel between the gamma data control unit 630 and the data driver 400.

In particular, in the case where the gamma data control unit 630 receives the normal signal EN1, the first DA converter DA1 provides the first gamma voltage GMA1 to the data driver 400, the second DA converter DA2 provides the second gamma voltage GMA2 to the data driver 400, the third DA converter DA3 provides the third gamma voltage GMA3 to the data driver 400, and the fourth DA converter DA4 provides the fourth gamma voltage GMA4 to the data driver 400.

In the case where the gamma data control unit 630 receives the operating signal EN2, the first DA converter DA1 provides the first modulation voltage GMM1 to the data driver 400, the second DA converter DA2 provides the second modulation voltage GMM2 to the data driver 400, the third DA converter DA3 provides the third modulation voltage GMM3 to the data driver 400, and the fourth DA converter DA4 provides the fourth modulation voltage GMM4 to the data driver 400.

The gamma data GD1 is set so that the difference VH1 between the first and second gamma voltages and the difference VL1 between the third and fourth gamma voltages have the same value. The modulation data GD2 is set so that the difference VH2 between the first and second modulation voltages and the difference VL2 between the third and fourth modulation voltages have the same value.

The time adjuster 650 controls the variable time TT over which the gamma data GD1 is changed to the modulation data GD2. The variable time TT is a time between when the gamma data control unit 630 receives the operating signal EN2 and when the gamma data control unit 630 outputs the modulation data GD2.

The time adjuster 650 outputs the variable time TT to the gamma data control unit 630 to gradually change the first to fourth gamma voltages GMA1 to GMA4 to the first to fourth modulation voltages GMM1 to GMM4 for the variable time TT. This prevents a variation in brightness from becoming recognized.

The driving voltage supply unit 660 supplies the driving voltage AVDD to the DA converter unit 640. The first to fourth gamma voltages GMA1 to GMA4 and the first to fourth modulation voltages GMM1 to GMM4 are lower than the driving voltage AVDD.

Figure 8:
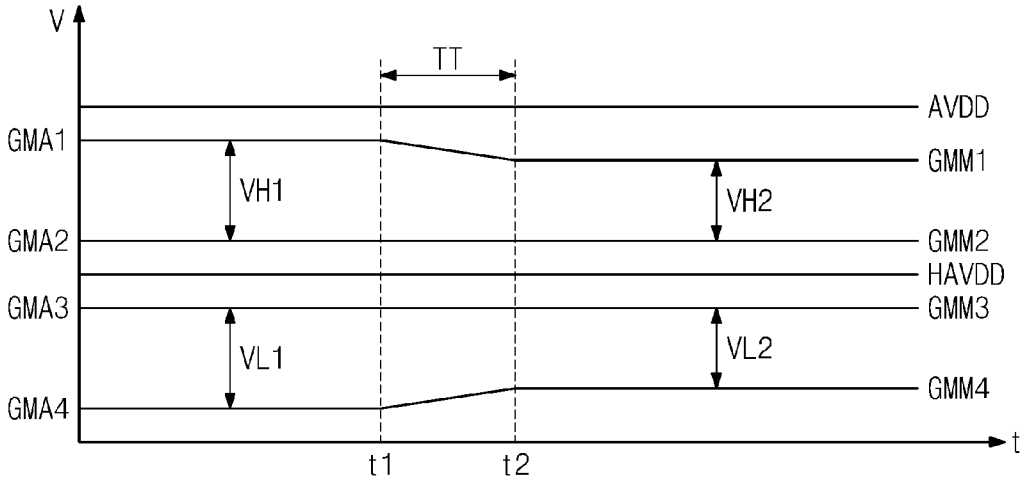
FIG. 8 is a graph of an output voltage of the power supply unit in FIG. 7.

FIG. 8 is a graph of an output voltage of the power supply unit 600 in FIG. 7. Unlike FIG. 5, the driving voltage AVDD and the half driving voltage HAVDD do not vary as time elapses.

The target pattern PA is not sensed until the first time t1. The DA converter unit 640 receives the gamma data GD1 to output the first to fourth gamma voltages GMA1 to GMA4. The difference VH1 between the first and second gamma voltages and the difference VL1 between the third and fourth gamma voltages have the same value and are symmetric with respect to the half driving voltage HAVDD.

At the first time t1, the target pattern PA is sensed and the gamma data control unit 630 receives the operating signal EN2. The gamma data control unit 630 receiving the operating signal EN2 may not immediately output the modulation data GD2 at the first time t1. The reason is that a variation in brightness of an image may be recognized.

From the first time t1 to the second time t2, the gamma data control unit 630 changes data to be provided to the DA converter 640, from the gamma data GD1 to the modulation data GD2. The maximum gray level of a positive data voltage and the maximum gray level of a negative data voltage gradually decrease. The difference VH1 between the first and second gamma voltages gradually decrease to the difference VH2 between the first and second modulation voltages. The difference VL1 between the third and fourth gamma voltages gradually decrease to the difference VL2 between the third and fourth modulation voltages. A time over which the gamma data GD1 is changed to the modulation data GD2 is determined by the variable time TT that is set by the time adjuster 650. The variable time TT is a time between the second time t2 and the first time t1.

From the second time t2, the modulation data GD2 is applied to the DA converter unit 640. The DA converter unit 640 receives the modulation data GD2 to output the first to fourth modulation voltages GMM1 to GMM4. The difference VH2 between the first and second modulation voltages is smaller than the difference VH1 between the first and second gamma voltages, and the difference VL2 between the third and fourth modulation voltages is smaller than the difference VL1 between the third and fourth gamma voltages. A decrease in the differences VH2 and VL2 with respect to VH1 and VL1 may be sufficient to reduce power consumption; accordingly, each of the first to fourth modulation voltages GMM1 to GMM4 may not have to be lower than the respective first to fourth gamma voltages GMA1 to GMA4. The difference VH2 between the first and second modulation voltages and the difference VL2 between the third and fourth modulation voltages have the same value and are symmetric with respect to the half driving voltage HAVDD.

In one embodiment, the driving voltage AVDD is fixed to about 17 V. The difference VH1 between the first and second gamma voltages and the difference VL1 between the third and fourth gamma voltages are each about 7.11 V. The difference VH2 between the first and second modulation voltages and the difference VL2 between the third and fourth modulation voltages are each about 5.85V as in FIG. 5. Power consumption may be decreased by about 22% from about 26.9 W to about 22.6 W.

When comparing FIG. 5 with FIG. 8, in some embodiments, the difference VH1 between the first and second gamma voltages and the difference VL1 between the third and fourth gamma voltages before receiving the operating signal EN2 are each about 7.11 V, and the difference VH2 between the first and second modulation voltages and the difference VL2 between the third and fourth modulation voltages after receiving the operating signal EN2 are each about 5.85 V. In this case, power consumption in FIG. 5 according to the power supply unit 500 is about 18.3 W and thus represents a reduction ratio of about 32%, and power consumption in FIG. 8 according to the power supply unit 600 is about 22.6 W and thus represents a reduction ratio of about 22%. The power supply unit 500, in FIG. 5, changes the amplitude of a driving voltage, and the maximum gray levels of positive and negative data voltages. The power supply unit 600, in FIG. 8, changes the maximum gray levels of positive and negative data voltages, but not the amplitude of a driving voltage. Thus, the power supply unit 500, in FIG. 5, has a better effect in power decrease than the power supply unit 600, in FIG. 8.

Figure 9:
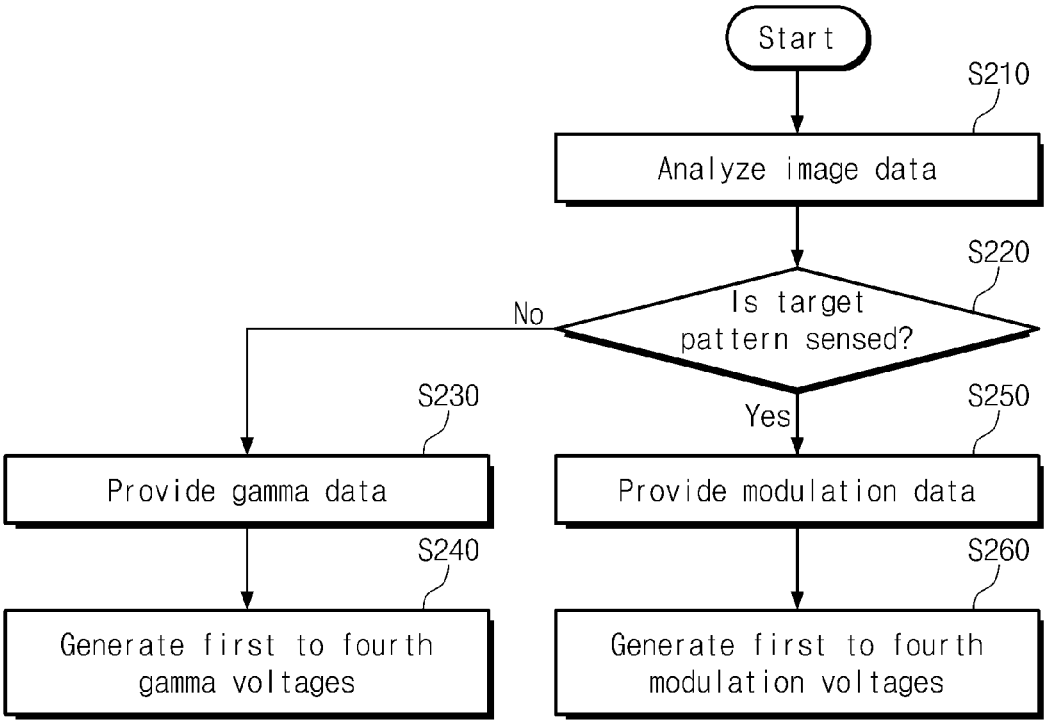
FIG. 9 is a flow chart of a driving method of an LCD according to another embodiment of the present disclosure.

FIG. 9 is a flow chart of a driving method of the LCD 1000 according to another embodiment of the present disclosure. The driving method of the LCD 1000 in FIG. 9 may be performed by the power supply unit 600 and timing controller 200 in FIG. 7.

Referring to FIG. 9, the driving method of the LCD 1000 includes analyzing the image data RGB in act S210 and sensing the target pattern in act S220. In the case where the target pattern PA is not sensed, the method further includes providing the gamma data GD1 in act S230 and generating the first to fourth gamma voltages GMA1 to GMA4 in act S240. In the case where the target pattern PA is sensed, the method further includes providing the modulation data GD2 in act S250 and generating the first to fourth modulation voltages GMM1 to GMM4 in act S260.

After generating the first to fourth gamma voltages GMA1 to GMA4 in act S240, the analyzing of the image data RGB in act S210 and the sensing of the target pattern PA in act S220 may be repeated. In the case where the target pattern PA is sensed, the providing of the modulation data GD2 in act S250 and the generating of the first to fourth modulation voltages GMM1 to GMM4 in act S260 are performed. In this case, the providing of the modulation data GD2 in act S250 may be performed after the variable time TT from when the target pattern PA is sensed. After generating the first to fourth modulation voltages GMM1 to GMM4 in act S260, the analyzing of the image data RGB in act S210 and the sensing of the target pattern PA in act S220 may be repeated.

Figure 10:
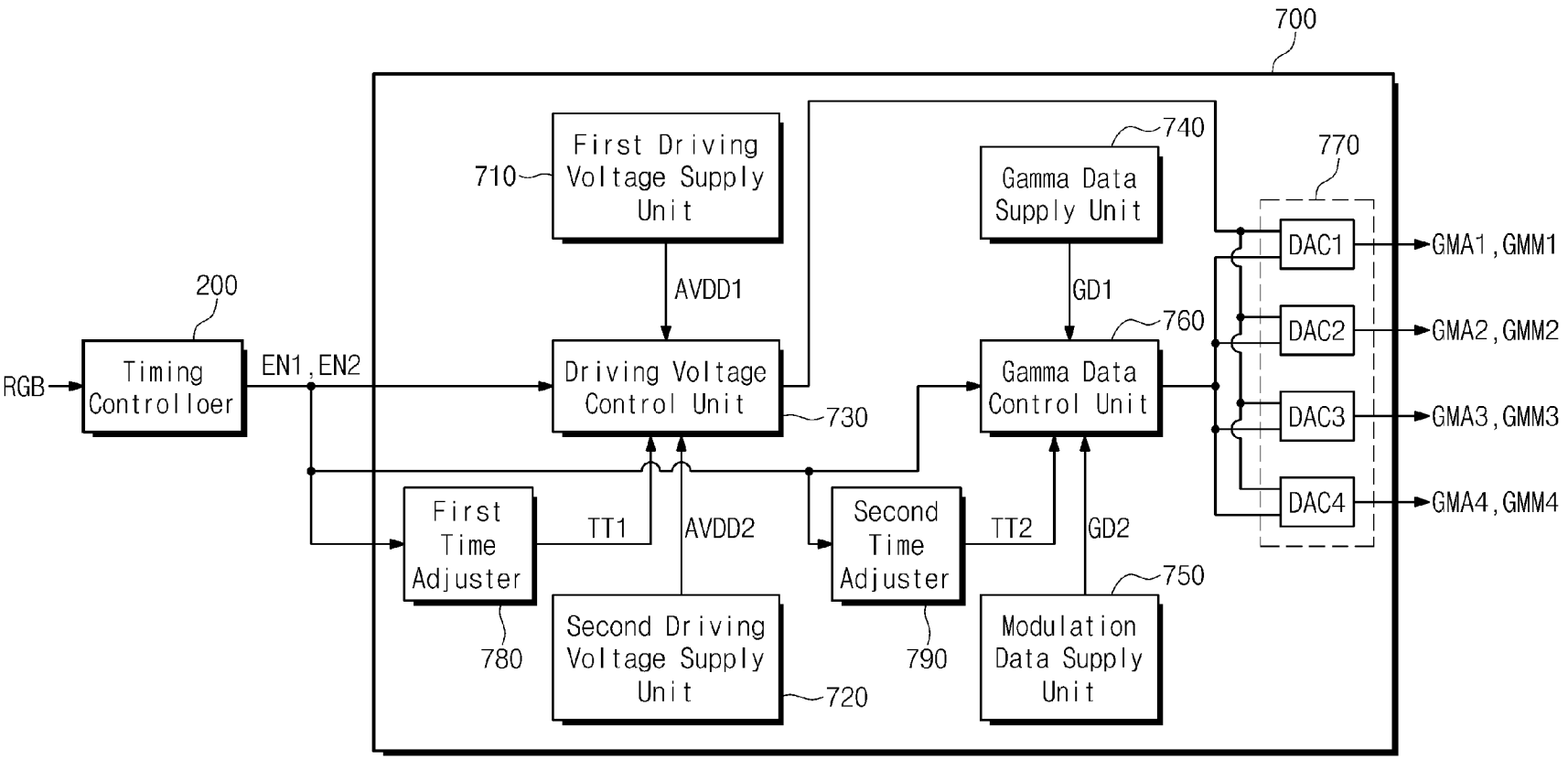
FIG. 10 is a block diagram of a timing controller and a power supply unit according to another embodiment of the present disclosure.

FIG. 10 is a block diagram of the timing controller 200 and a power supply unit 700 according to another embodiment of the present disclosure.

The power supply unit 700 includes a first driving voltage supply unit 710, a second driving voltage supply unit 720, a driving voltage control unit 730, a gamma data supply unit 740, a modulation data supply unit 750, a gamma data control unit 760, a DA converter unit 770, a first time adjuster 780, and a second time adjuster 790.

The gamma data supply unit 740, the modulation data supply unit 750, the gamma data control unit 760, the DA converter unit 770, and the second time adjuster 790 of the power supply unit 700 have the same functions and effects as the power supply unit 600 in FIG. 7.

The first driving voltage supply unit 710, the second driving voltage supply unit 720, the driving voltage control unit 730, and the first time adjuster 780 of the power supply unit 700 may have the same functions and effects as their equivalents in the power supply unit 500 in FIG. 2.

The first driving voltage supply unit 710 and the gamma data supply unit 740 are used in generating the first to fourth gamma voltages GMA1 to GMA4. The second driving voltage supply unit 720 and the modulation data supply unit 750 are used in generating the first to fourth modulation voltages GMM1 to GMM4.

When the driving voltage control unit 730 receives the operating signal EN2, it outputs the second driving voltage AVDD2 which is lower than the first driving voltage AVDD1 to the DA converter unit 770 after a first variable time TT1. When the gamma data control unit 760 receives the operating signal EN2, it outputs the modulation data GD2 to the DA converter unit 770 after a second variable time TT2.

The first time adjuster 780 controls the first variable time TT1 over which the first driving voltage AVDD1 is changed to the second driving voltage AVDD2. The second time adjuster 790 controls the second variable time TT2 over which the gamma data GD1 is changed to the modulation data GD2. The first time adjuster 780 provides the first variable time TT1 to the driving voltage control unit 730. The second time adjuster 790 provides the second variable time TT2 to the gamma data control unit 760.

Figure 11:
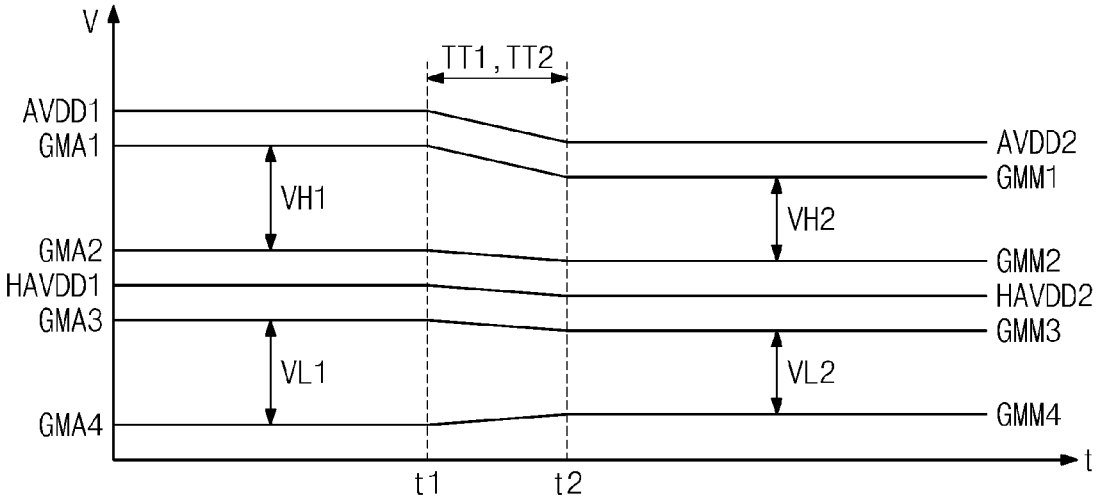
FIG. 11 is a graph of an output voltage of the power supply unit in FIG. 10.

FIG. 11 is a graph of an output voltage of the power supply unit 700 in FIG. 10.

At a first time t1, the target pattern PA is sensed and the driving voltage control unit 730 and the gamma data control unit 760 receive the operating signal EN2. From the first time t1 to a second time t2, the driving voltage control unit 730 gradually lowers the voltage applied to the DA converter unit 770 from the first driving voltage AVDD1 to the second driving voltage AVDD2. At the same time, the gamma data control unit 760 changes data to be provided to the DA converter unit 770 from the gamma data GD1 to the modulation data GD2.

A time taken to lower the first driving voltage AVDD1 to the second driving voltage AVDD2 is determined by the first variable time TT1 that is set by the first time adjuster 780. A time for which the gamma data GD1 is changed to the modulation data GD2 is determined by the second variable time TT2 that is set by the second time adjuster 790. In the embodiment shown in FIG. 11, TT1 and TT2 are the same. In an alternative embodiment, TT1 and TT2 can be different. In that embodiment, the power supply unit 700 will not output the first to fourth modulation voltages GMM1 to GMM4 until the longer of TT1 and TT2 has elapsed.

Figure 12:
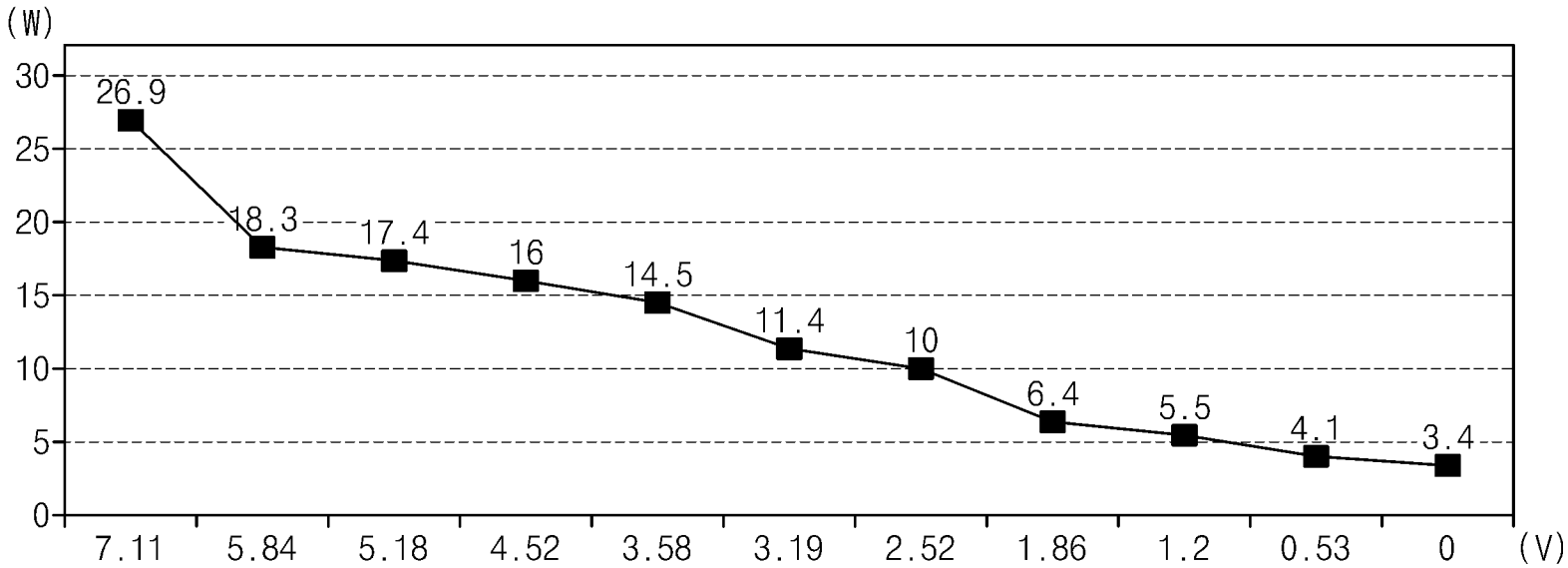
FIG. 12 is a graph of the power consumption of the power supply unit in FIGS. 10.

FIG. 12 is a graph of the power consumption of the power supply unit 700 in FIG. 10. In one embodiment, in the case where the difference VH2 between the first and second modulation voltages and the difference VL2 between the third and fourth modulation voltages are the same, FIG. 12 illustrates the relationship between the difference VH2 of the first and second modulation voltages (or the difference VL2 between the third and fourth modulation voltages) and the power consumption. The first driving voltage AVDD1 is fixed to about 17 V and the second driving voltage AVDD2 is fixed to about 14 V.

7.11 V represents the difference VH1 between the first and second gamma voltages. That is, this is the case where the first driving voltage AVDD1 of about 17 V is applied. The point at 7.11 V represents the power consumption in a state in which the target pattern PA is not sensed, and the power consumption is about 26.9 W.

The following voltage values represent the difference VH2 between the first and second modulation voltages. That is, this is the case where the second driving voltage AVDD2 of about 14 V is applied. The modulation data GD2 is applied in a state in which the target pattern PA is sensed, and FIG. 12 shows the relationship between the difference VH2 between the first and second modulation voltages and the power consumption.

In the case where the difference VH2 between the first and second modulation voltages is about 3.5 V, power consumption is decreased by about 50%. With a decrease in power consumption, the brightness of the liquid crystal display panel 100 is low and the panel darkens. Thus, it is desirable to determine the difference VH2 between the first and second modulation voltages in consideration of brightness and power consumption.

Figure 13:
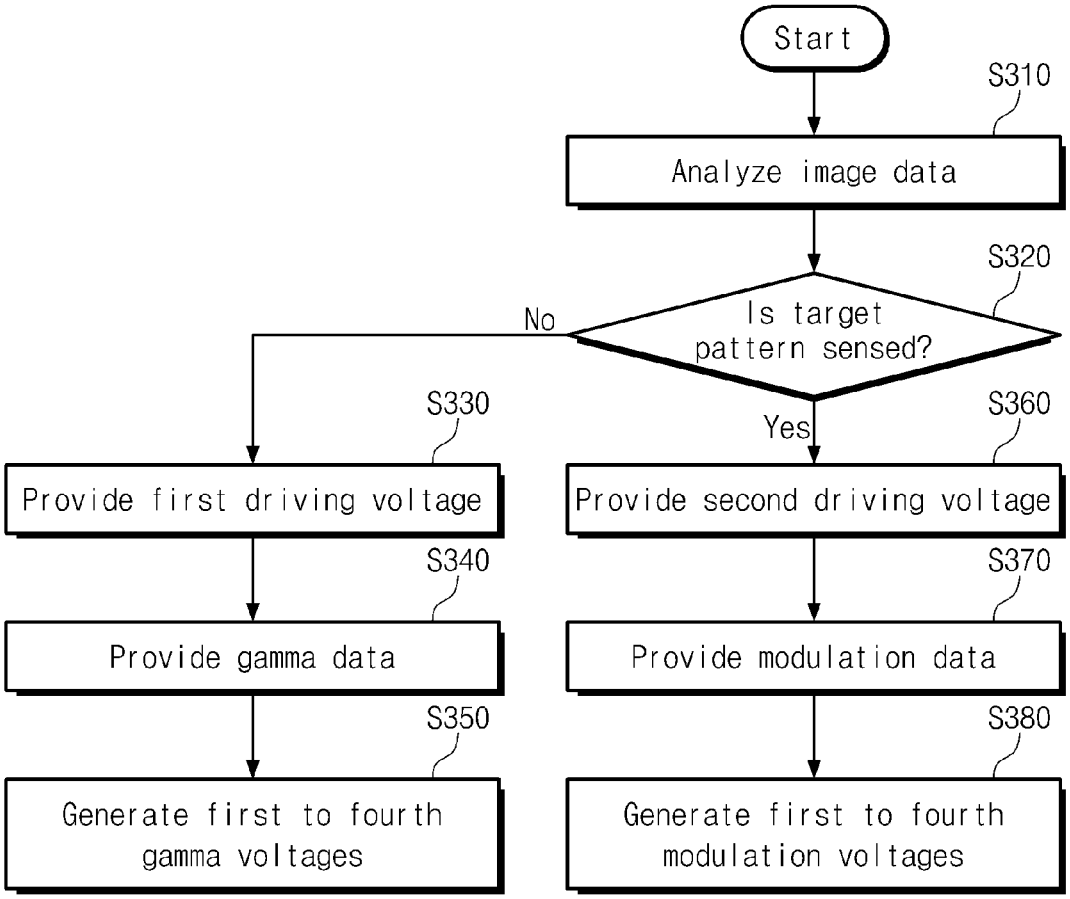
FIG. 13 is a flow chart of a driving method of an LCD according to another embodiment of the present disclosure.

FIG. 13 is a flow chart of a driving method of the LCD 1000 according to another embodiment of the present disclosure. The driving method of the LCD 1000 in FIG. 13 may be performed by the power supply unit 700 and timing controller 200 in FIG. 10.

Referring to FIG. 13, the driving method of the LCD 1000 includes analyzing the image data RGB in act S310 and sensing the target pattern in act S320. In the case where the target pattern PA is not sensed, the method further includes providing the first driving voltage AVDD1 in act S330, providing the gamma data GD1 in act S340, and generating the first to fourth gamma voltages GMA1 to GMA4 in act S350. In the case where the target pattern PA is sensed, the method further includes providing the second driving voltage AVDD2 in act S360, providing the modulation data GD2 in act S370, and generating the first to fourth modulation voltages GMM1 to GMM4 in act S380.

In view of the foregoing and in certain embodiments, the LCD and the driving method thereof may convert a driving voltage and/or gamma data to decrease the power consumption of the LCD and inhibit heat emission in the case where the target pattern PA is sensed.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The present disclosure is not limited to the embodiments disclosed. Modifications and variations which would be obvious to a person skilled in the art may be implemented without departing from the spirit and scope of the present disclosure. Thus, it is considered that such modifications or variations are within the scope of the following claims, and equivalents thereof.

What is claimed is:

1. A liquid crystal display device comprising:

a timing controller configured to analyze image data to sense a target pattern, generate an operating signal in a case where the target pattern is sensed, and generate converted data based on the image data;

a power supply unit configured to generate first to fourth gamma voltages in a case where the operating signal is not received, and generate first to fourth modulation voltages in a case where the operating signal is received;

a data driver configured to receive the converted data and convert the converted data into a data voltage based on the first to fourth gamma voltages and/or the first to fourth modulation voltages; and a liquid crystal display panel comprising a data line configured to receive the data voltage, a gate line crossing the data line, and a pixel that is connected to the data line and to the gate line, wherein a difference between the first and second gamma voltages is a positive data voltage corresponding to a maximum gray level and a difference between the third and fourth gamma voltages is a negative data voltage corresponding to a maximum gray level, in a case where the operating signal is not received, a difference between the first and second modulation voltages is a positive data voltage corresponding to a maximum gray level and a difference between the third and fourth modulation voltages is a negative data voltage corresponding to a maximum gray level, in a case where the operating signal is received, and the difference between the first and second modulation voltages is smaller than the difference between the first and second gamma voltages and the difference between the third and fourth modulation voltages is smaller than the difference between the third and fourth gamma voltages.

2. The liquid crystal display device of claim 1, wherein the power supply unit comprises:

a first driving voltage supply unit configured to generate a first driving voltage for generating the first to fourth gamma voltages;

a second driving voltage supply unit configured to generate a second driving voltage for generating the first to fourth modulation voltages, wherein the second driving voltage is lower than the first driving voltage;

a driving voltage control unit configured to output the first driving voltage in a case where the operating signal is not received, and output the second driving voltage after a variable time in a case where the operating signal is received; and a resistor unit connected to the driving voltage control unit and configured to receive the first driving voltage to output the first to fourth gamma voltages to the data driver or receive the second driving voltage to output the first to fourth modulation voltages to the data driver.

3. The liquid crystal display device of claim 2, wherein the resistor unit comprises:

a first resistor having one terminal connected to the driving voltage control unit and another terminal to provide the first gamma voltage or the first modulation voltage;

a second resistor having one terminal connected to the other terminal of the first resistor and another terminal to provide the second gamma voltage or the second modulation voltage;

a third resistor having one terminal connected to the other terminal of the second resistor and another terminal to provide the third gamma voltage or the third modulation voltage;

a fourth resistor having one terminal connected to the other terminal of the third resistor and another terminal to provide the fourth gamma voltage or the fourth modulation voltage; and a fifth resistor having one terminal connected to the other terminal of the fourth resistor and another terminal being grounded.

4. The liquid crystal display device of claim 3, wherein the first resistor and the fifth resistor have a same resistance, and the second resistor and the fourth resistor have a same resistance.

5. The liquid crystal display device of claim 2, wherein the power supply unit further comprises a time adjuster configured to control the variable time.

6. The liquid crystal display device of claim 1, wherein the power supply unit comprises:

a gamma data supply unit configured to generate gamma data for generating the first to fourth gamma voltages;

a modulation data supply unit configured to generate modulation data for generating the first to fourth modulation voltages;

a gamma data control unit configured to output the gamma data in a case where the operating signal is not received, and output the modulation data after a variable time in a case where the operating signal is received; and a digital to analog converter unit connected to the gamma data control unit and configured to receive the gamma data to output the first to fourth gamma voltages to the data driver or receive the modulation data to output the first to fourth modulation voltages to the data driver.

7. The liquid crystal display device of claim 6, wherein the digital to analog converter unit comprises:

a first digital to analog converter having one terminal connected to the gamma data control unit and another terminal providing the first gamma voltage or the first modulation voltage to the data driver;

a second digital to analog converter having one terminal connected to the gamma data control unit and another terminal providing the second gamma voltage or the second modulation voltage to the data driver;

a third digital to analog converter having one terminal connected to the gamma data control unit and another terminal providing the third gamma voltage or the third modulation voltage to the data driver; and a fourth digital to analog converter having one terminal connected to the gamma data control unit and another terminal providing the fourth gamma voltage or the fourth modulation voltage to the data driver.

8. The liquid crystal display device of claim 7, wherein a difference between the first and second gamma voltages and a difference between the third and fourth gamma voltages are same, and a difference between the first and second modulation voltages and a difference between the third and fourth modulation voltages are same.

9. The liquid crystal display device of claim 6, wherein the power supply unit further comprises a time adjuster configured to control the variable time.

10. The liquid crystal display device of claim 6, wherein the power supply unit comprises:

a first driving voltage supply unit configured to generate a first driving voltage for generating the first to fourth gamma voltages;

a second driving voltage supply unit configured to generate a second driving voltage for generating the first to fourth modulation voltages, wherein the second driving voltage is lower than the first driving voltage; and a driving voltage control unit configured to output the first driving voltage to the digital to analog converter unit in a case where the operating signal is not received, and output the second driving voltage to the digital to analog converter unit after the variable time in a case where the operating signal is received.

11. The liquid crystal display device of claim 10, wherein a difference between the first and second gamma voltages and a difference between the third and fourth gamma voltages are same, and a difference between the first and second modulation voltages and a difference between the third and fourth modulation voltages are same.

12. The liquid crystal display device of claim 10, wherein the power supply unit further comprises a time adjuster configured to control the variable time.

13. A driving method of a liquid crystal display device, the method comprising:

generating first and second gamma voltages that determine a maximum gray level corresponding to a positive data voltage, and third and fourth gamma voltages that determine a maximum gray level corresponding to a negative data voltage;

sensing a target pattern by analyzing input data to generate an operating signal; and based on the operating signal, generating first and second modulation voltages that determine a maximum gray level corresponding to a positive data voltage, and third and fourth modulation voltages that determine a maximum gray level corresponding to a negative data voltage, wherein a difference between the first and second modulation voltages is smaller than a difference between the first and second gamma voltages, and a difference between the third and fourth modulation voltages is smaller than a difference between the third and fourth gamma voltages.

14. The driving method of claim 13, wherein the generating of the gamma voltages comprises:

providing a first driving voltage to a voltage divider unit; and dividing the first driving voltage to generate the first to fourth gamma voltages.

15. The driving method of claim 14, wherein the generating of the modulation voltages comprises:

providing a second driving voltage lower than the first driving voltage to a voltage divider unit; and dividing the second driving voltage to generate the first to fourth modulation voltages.

16. The driving method of claim 13, wherein the generating of the gamma voltages comprises:

providing gamma data to a digital to analog converter unit; and generating the first to fourth gamma voltages based on the gamma data.

17. The driving method of claim 16, wherein the generating of the modulation voltages comprises:

providing modulation data to the digital to analog converter unit; and generating the first to fourth modulation voltages based on the modulation data.

18. The driving method of claim 17, wherein the generating of the gamma voltages further comprises providing a first driving voltage to the digital to analog converter unit, and the generating of the modulation voltages further comprises providing a second driving voltage lower than the first driving voltage to the digital to analog converter unit.

19. The driving method of claim 13, wherein a difference between the first and second gamma voltages and a difference between the third and fourth gamma voltages are same, and a difference between the first and second modulation voltages and a difference between the third and fourth modulation voltages are same.

20. The driving method of claim 13, wherein the generating of the modulation voltages further comprises setting a variable time over which the first to fourth gamma voltages are changed to the first to fourth modulation voltages.

* * * * *